US011807019B2

(12) United States Patent
Askeland et al.

(10) Patent No.: US 11,807,019 B2
(45) Date of Patent: Nov. 7, 2023

(54) PRINTING FLUID CIRCULATION

(71) Applicant: Hewlett-Packard Development Company, L.P., Spring, TX (US)

(72) Inventors: Ronald Albert Askeland, San Diego, CA (US); Blair A. Butler, San Diego, CA (US); Ronald J. Ender, Corvallis, OR (US); Craig L. Malik, Corvallis, OR (US); Daniel D. Dowell, Corvallis, OR (US); Seth Stephen Haddix, Corvallis, OR (US); Si-Lam J. Choy, Corvallis, OR (US); Alexander Govyadinov, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 25 days.

(21) Appl. No.: 17/312,366

(22) PCT Filed: Jul. 31, 2019

(86) PCT No.: PCT/US2019/044492
§ 371 (c)(1),
(2) Date: Jun. 9, 2021

(87) PCT Pub. No.: WO2021/021193
PCT Pub. Date: Feb. 4, 2021

(65) Prior Publication Data

US 2022/0161568 A1 May 26, 2022

(51) Int. Cl.
*B41J 2/175* (2006.01)

(52) U.S. Cl.
CPC ..... *B41J 2/17596* (2013.01)

(58) Field of Classification Search
CPC ..... B41J 2/17596; B41J 2/17553; B41J 2/17513; B41J 2/14145; B41J 2/18; B41J 2202/12
See application file for complete search history.

(56) References Cited

U.S. PATENT DOCUMENTS 6,631,983 B2 10/2003 Romano, Jr. et al.
6,880,926 B2 4/2005 Childs et al.
7,862,138 B2 1/2011 Haines et al.
(Continued)

FOREIGN PATENT DOCUMENTS

AU 2006201083 A1 10/2007
CN 101503023 A 8/2009
(Continued)

OTHER PUBLICATIONS

The sample release of the new 600 dpi ink re-circulation type inkjet head "CF3R" and ultra-small ink re-circulation device "CC1", world's smallest and lightest *1, has started., Nov. 1, 2018, Toshiba Tec Corporation, 1 page.

*Primary Examiner* — An H Do
(74) *Attorney, Agent, or Firm* — Foley & Lardner LLP

(57) ABSTRACT

A printing fluid pen includes a plurality of fluid ports, a pressure regulator in fluid communication with a first fluid port, and a valve in fluid communication with a second fluid port. The first fluid port is to deliver printing fluid to a fluid ejection device, and the second fluid port is to direct printing fluid out of the pen. In response to negative pressure, the valve is to open to enable fluids within the pen to exit via the second port.

16 Claims, 6 Drawing Sheets

(56) References Cited

U.S. PATENT DOCUMENTS

| | | | | |
|---|---|---|---|---|
| 8,444,259 | B2 | 5/2013 | Bennett | |
| 8,714,721 | B2 | 5/2014 | Frazier et al. | |
| 9,676,186 | B2 | 6/2017 | Taff | |
| 9,895,888 | B2 * | 2/2018 | Chen | B41J 2/1404 |
| 9,925,791 | B2 * | 3/2018 | Yamada | B41J 2/1404 |
| 10,086,612 | B2 | 10/2018 | Rivas et al. | |
| 10,906,320 | B2 * | 2/2021 | Wood | B41J 2/175 |
| 2006/0066697 | A1 | 3/2006 | Inque | |
| 2006/0181571 | A1 | 8/2006 | Yasushi | |
| 2009/0091606 | A1 | 4/2009 | Haines et al. | |
| 2010/0283819 | A1 | 11/2010 | Tamaru et al. | |
| 2011/0228017 | A1 | 9/2011 | Dyer et al. | |
| 2012/0206519 | A1 | 8/2012 | Aono et al. | |
| 2013/0169710 | A1 | 7/2013 | Keefe et al. | |
| 2018/0281419 | A1 | 10/2018 | Clippingdale et al. | |

FOREIGN PATENT DOCUMENTS

| | | | |
|---|---|---|---|
| CN | 101879815 | A | 11/2010 |
| CN | 103153625 | A | 6/2013 |
| JP | 2006-095766 | A | 4/2006 |
| JP | 5425850 | B2 | 2/2014 |
| WO | WO-2007098527 | A1 | 9/2007 |
| WO | 2017/098962 | A1 | 6/2017 |
| WO | 2019/103752 | A1 | 5/2019 |

* cited by examiner

PRINTING FLUID CIRCULATION

BACKGROUND

Printing devices may, at times, eject printing fluid received from a fluid reservoir. The printing fluids may contain colorants that may be made up of solids suspended in a fluid. The printing fluids may be ejected from the printing device via fluid ejection devices, such as including nozzles and ejection chambers, to deposit droplets of printing fluid on a medium or materials.

BRIEF DESCRIPTION OF THE DRAWINGS

Various examples will be described below by referring to the following figures.

Figure 1:
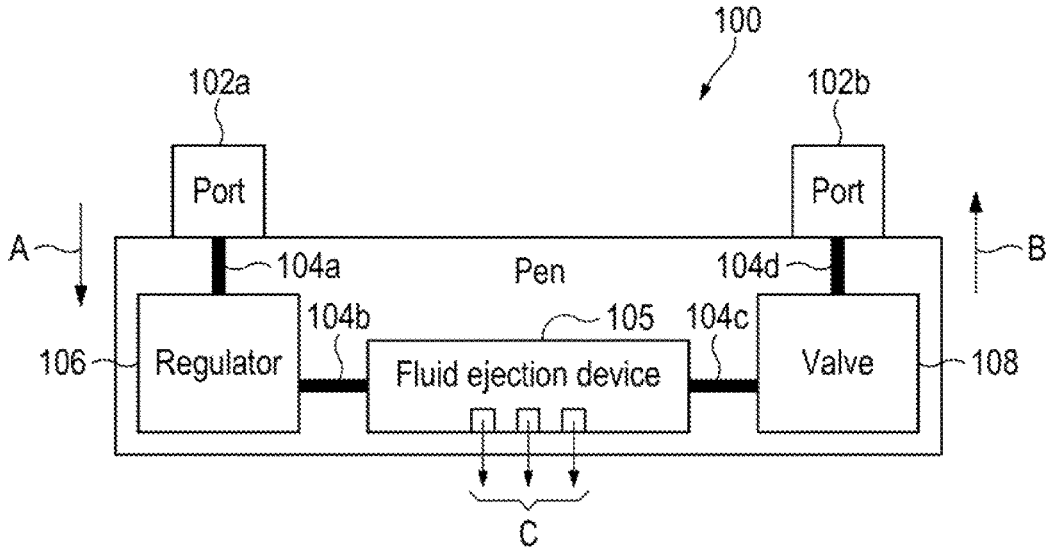
FIG. 1 is a block diagram illustrating an example printing fluid ejection pen.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration.

DETAILED DESCRIPTION throughout this specification to one implementation, an implementation, one case, an example, and/or the like means that a particular feature, structure, characteristic, and/or the like described in relation to a particular implementation, case, and/or example is included in an implementation, case, and/or example of claimed subject matter. Thus, appearances of such phrases, for example, in various places throughout this specification are not necessarily intended to refer to the same implementation, case, and/or example or to any one particular implementation, case, and/or example. Furthermore, it is to be understood that particular features, structures, characteristics, and/or the like described are capable of being combined in various ways in different implementations, cases, and/or examples and, therefore, are within intended claim scope. In general, of course, as has always been the case for the specification of a patent application, these and other issues have a potential to vary in a particular context of usage. In other words, throughout the disclosure, particular context of description and/or usage provides helpful guidance regarding reasonable inferences to be drawn; however, likewise, "in this context" in general without further qualification refers to the context of the present disclosure.

There may be a desire to cause printing fluid to circulate within and/or in proximity to a fluid ejection device. As used herein, the term fluid ejection device refers to a thermal ink ejection device (TIJ) or piezo ejection device (PIJ), by way of non-limiting example. For example, some printing fluids may include solids, such as pigments, that may settle while the printing fluid remains static or in a state of non-motion. In such cases, fluid flow may be sufficient to keep the solids suspended within the fluids. In other cases, fluids may contain dissolved and/or suspended polymers (e.g., in addition to solids) that may also tend to settle. For example, as liquid evaporates concentration of the dissolved and/or suspended polymers may increase leading to increased viscosity and/or worsening decap. Additionally, components of a fluid ejection device (e.g., fluidic dies of a thermal inkjet device) may experience uneven heating, such as due to operation of resistive and/or thermal elements that may cause hot spots in the device. In such cases, fluidic circulation may also be of interest to dissipate thermal buildup at portions of the fluid ejection device. However, causing fluid to circulate may present certain structural and operational challenges to fluid devices. As used herein, the term "fluid circulation" and like terms refer to fluids that flow within fluid channels, such as within recirculation paths, in order to favorize solid suspension and/or thermal dissipation. To be clear, merely transporting fluids to an ejection chamber of a fluid ejection device is not what is contemplated by the term. Instead, fluid circulation refers to fluid paths that allow printing fluids to flow upon command, such as through fluid return paths (e.g., returning back towards a fluid reservoir). At times, the term recirculation is used to refer to circulation back out of a fluid ejection device, such as back towards a fluid reservoir.

Fluid ejection devices may include ejection nozzles (through which fluids, such as printing fluids, are to be ejected towards a medium or substrate), which openings may present challenges to maintaining a fluidic pressure (and thus a rate of fluid flow, or flux) within a fluid channel. For instance, backpressure within the fluid channels, such as due to ejection of printing fluid, may lead to drops in flux in some situations. By way of example, immediately after ejecting printing fluid from a nozzle, printing fluid may cease flowing through a fluid line, may briefly flow in a wrong direction along at least a portion of a fluid line, and/or may flow much more slowly.

Pressure regulators may be used maintain fluid pressure in a fluid line in a range about a set point, which can be desirable, such as to reduce the effects of backpressure. For example, fluids may flow through a pressure regulator prior to flowing towards fluid ejection orifices (e.g., nozzles), and the pressure regulator may dampen effects of backpressure.

It may be possible to enable fluid circulation within a fluid channel that uses pressure regulators on a fluid line corresponding to the fluid channel. This may be done by opening a fluidic element (e.g., a fluid gate) of the pressure regulator to allow fluid flow (e.g., circulation). However, opening the fluidic element of the pressure regulator to allow fluid circulation may lead to a loss of flux on the fluid channel. The loss of flux may contribute to undesirable print quality, such as due to a loss of control of printing fluid droplet size. As such, fluid circulation may be desirable only at points in time for which a drop of flux may be acceptable, such as while a fluid ejection device is being serviced.

With the foregoing in mind, there may be a desire, therefore, for an approach that will enable the use of pressure regulators (e.g., to dampen backflow spikes) and also allow circulation of printing fluid while a printing fluid ejection device is active (e.g., while ejecting printing fluid) without drops in flux (e.g., without flux decreasing below an operational threshold).

The present disclosure thus proposes a system in which a printing fluid pen has a number of fluid ports. A first fluid port is to deliver a printing fluid to an ejection device of the pen (e.g., an input port). A second fluid port is to direct printing fluid out of the pen (e.g., an output port). A pressure regulator is in fluid communication with the first fluid port. And a valve is in fluid communication with the second fluid port. The valve is to open in response to a negative pressure (e.g., negative pressure exceeding a threshold), to enable fluids within the pen to exit via the second fluid port.

The combination of a valve that opens in response to a negative pressure on the outlet port and the pressure regulator in fluid communication with the inlet port may enable fluid circulation, even while ejecting fluid, without undesirable drops in fluid flux (e.g., without flux decreasing below an operational threshold).

Turning to FIG. 1, a block diagram illustrates one implementation of a printing fluid pen 100. As used herein, the term "inkjet" will be used to refer to devices capable of ejecting printing fluids including, but not limited to, inks. Thus, for example, a pen of a three-dimensional (3D) printer may be used to eject an agent that may cause a build material to fuse together as part of an additive printing process. The agent may or may not include colorants, such as pigments. Therefore, by referring to a pen as an inkjet pen is not done in a limiting sense. Indeed, it is intended that such fluid ejection pens could be used in a number of different contexts. Additionally, the term "pen" refers to a structure that may include a housing in which a fluid ejection device and a fluidic die may be arranged along with other components in order to enable ejection of printing fluids. The inkjet pen may be removable in some cases, such as to enable replacement of individual pens without replacing an entire printbar.

In one example, an inkjet pen 100 may include a plurality of fluid ports, such as a first fluid port 102*a* and a second fluid port 102*b*. The first fluid port 102*a* may be in fluid communication with a regulator 106. As noted above, regulator 106 may refer to a component capable of managing pressure on a fluid line (e.g., the fluid lines illustrated by printing fluid lines 104*a*-104*d*). In one implementation, for instance, regulator 106 may operate by opening a fluidic gate in response to backpressure levels exceeding a threshold (e.g., a negative gauge pressure drops below a threshold valve). By opening the fluidic gate, regulator 106 allows more fluid into the fluid line and decreases the backpressure (e.g., increases the negative gauge pressure with an influx of printing fluid).

Regulator 106 may be in fluid communication with fluid ejection device 105, which may include a number of fluidic dies, and as shall be discussed in further detail hereinafter, the fluidic dies may be supported by a support component. Fluid ejection device 105 may be capable of ejecting printing fluid via nozzles, as illustrated by arrows C. Fluid ejection device 105 may be in fluid communication with a valve 108. Valve 108 may comprise a check valve, which may protect fluid ejection device 105 from printing fluid flowing back via fluid lines 104*c* and 104*d*. Instead, valve 108 may be opened in response to negative pressure applied at second fluid port 102*b* (e.g., via a vacuum pump). By way of further example, a check valve may prevent flow of fluid backwards (e.g., flowing back upstream towards fluid ejection device 105).

As shown, then, an example fluid ejection pen (e.g., inkjet pen 100) may comprise a plurality of fluid ports (e.g., first fluid port 102*a* and second fluid port 102*b*). A first fluid port may deliver printing fluid to a fluid ejection device (e.g., fluid ejection device 105) and a second fluid port may direct printing fluid out of the pen. A pressure regulator (e.g., regulator 106) may be in fluid communication with the first fluid port of the plurality of fluid ports. And a valve (e.g., valve 108) may be in fluid communication with a second port of the plurality of fluid ports. In response to negative pressure, the valve may open to enable fluids within the fluid ejection device to circulate and exit via the second port.

FIG. 1 includes arrows A, B, and C, which illustrate a direction in which printing fluid may flow according to one implementation. For example, printing fluid may flow into pen 100 via first fluid port 102*a*, as demonstrated by arrow A. A portion of the printing fluid may be ejected via fluid ejection device 105, as illustrated by arrows C. Another portion of the printing fluid may be directed out of pen 100 via valve 108 and second port 102*b*, as illustrated by arrow B.

It should apparent from the foregoing description, that it may be possible to modulate a circulation flux. For example, modulation of a positive pressure on first fluid port 102*a* may lead to increases and/or decreases in printing fluid flux entering pen 100 (e.g., directly and/or indirectly). And modulation of a negative pressure on second fluid port 102*b* may lead to increases and/or decrease in printing fluid flux leaving pen 100. Desired circulation flux may therefore be achieved by appropriately setting pressure values at input and output fluid ports (e.g., fluid ports 102*a* and 102*b*).

Figure 2A:
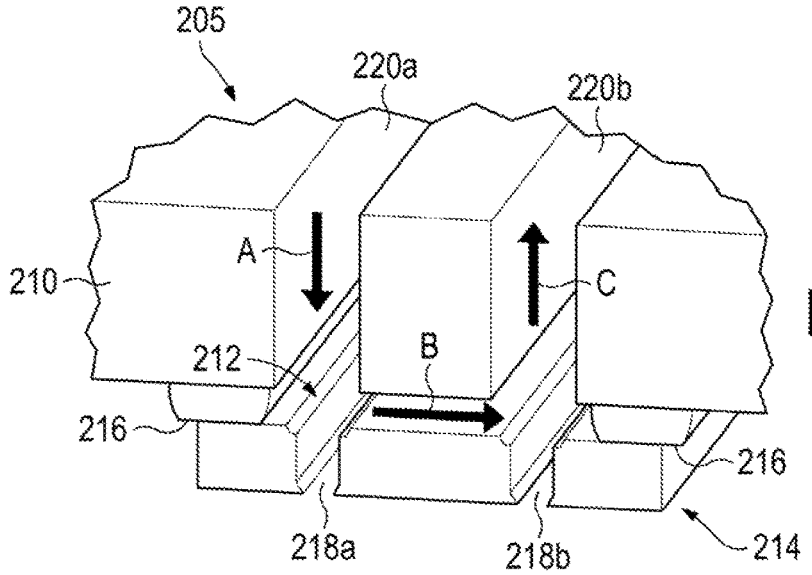
FIGS. 2A and 2B illustrate example fluid ejection devices.
Figure 2B:
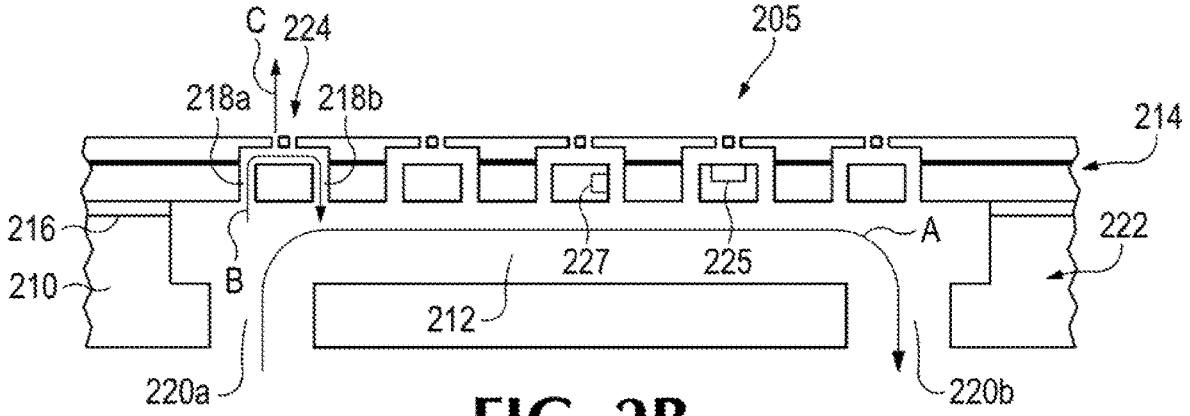

Turning to FIGS. 2A and 2B, example fluid ejection devices 205 are illustrated. These drawings show different components of fluid ejection device 205 in different examples. Fluid ejection devices 205 may be similar in structure and/or operation to fluid ejection device 105 in FIG. 1. It is noted that the present description uses like element numbers to indicate elements and components that may be similar in structure and/or function. For example, an inkjet pen 100 in FIG. 1 may be similar in structure and/or operation to an inkjet pen 400, as shall be discussed hereinafter in relation to FIG. 4. It is noted that portions of the description may refer to structure and/or operation of an implementation. While, in some cases, this discussion may apply to other figures and/or implementations, the reader will understand that this may not always be the case, as the context of the description may make clear.

Returning to FIG. 2A, fluid ejection device 205 includes a support component 210 and a fluidic die 214. Support component 210 comprises a structure, such as a molded structure like a thermoplastic or an epoxy, that provides physical support to fluidic die 214. Support component 210 may be manufactured using a molding process, a machining process, or a layer build-up process, by way of example. Fluid slots 220*a* and 220*b* may carry printing fluids towards and/or away from fluidic die 214. Fluidic die 214 may comprise a semiconductor material and may include a number of layers making up fluid channels and slots (e.g., fluid feed holes 218*a* and 218*b*), ejection chambers, and nozzles (e.g., nozzles 224 in FIG. 2B). Fluidic die 214 may also include ejection components, such as resistive components or piezoelectric membranes, by way of example, that may be activated to eject printing fluid from the nozzles.

There may be a space or gap between support component 210 and fluidic die 214 through which printing fluid may circulate. As illustrated, fluid channel 212 may be defined by a gap in support component 210 and/or a gap in adhesive layer 216. Fluid channel 212 may be used to enable circulation of printing fluid, such as illustrated by arrows A, B, and C, in FIG. 2A.

In operation, an inkjet pen (e.g., inkjet pen 100 of FIG. 1) may include a support component (e.g., support component 210) connected to a fluidic die (e.g., fluidic die 214). A fluid channel (e.g., fluid channel 212) may be arranged in relation to the support component in proximity to a backside of the fluidic die. The backside of the fluidic die refers to the surface of fluidic die between the fluidic die and the support component. As such, in some examples, printing fluid flowing through the fluid channel may flow in contact with the backside of the fluidic die.

As described above, the fluidic die may comprise a plurality of fluid feed holes (e.g., fluid feed holes 218*a* and 218*b*) and the fluid channel is arranged to be in fluid communication with the plurality of fluid feed holes.

Additionally, in some examples, in addition to providing circulation in proximity to the backside of the fluidic die, the fluid ejection device may also provide fluid circulation within microfluidic channels within the die, as shall be illustrated by FIG. 2B.

Turning to FIG. 2B, a fluid ejection device 205 is illustrated with components that are similar to those discussed in relation to FIG. 2A. For example, fluidic die 214 may be similar in structure and/or operation to fluidic die 214 of FIG. 2A, adhesive layer 216 may be similar in structure and/or operation to adhesive layer 216 of FIG. 2A, and support component 210 may be similar in structure and/or operation to support component 210 of FIG. 2A. FIG. 2B also illustrates fluid slots 220*a* and 220*b*, fluid channel 212, and fluid feed holes 218*a* and 218*b*, which are similar in structure and/or operation to those discussed in relation to FIG. 2A. The combination of fluid channel 212, fluid slots 220*a* and 220*b*, and fluid feed holes 218*a* and 218*b* may be referred to collectively as a fluid flow path 222, as illustrated by arrows, A and B. Additionally, fluid may be ejected from nozzles, such as nozzle 224, as illustrated by arrow C. An example ejection component 225 is illustrated in proximity to a different nozzle and is intended to contemplate thermal-based ejection elements, piezo-based ejection elements, and the like. It is to be understood that ejection elements, such as ejection component 225, may be arranged in each ejection chamber from which it may be desired to eject printing fluid.

In contrast to the arrangement of fluid feed holes 218*a* and 218*b* in FIG. 2A, fluid feed holes 218*a* and 218*b* in FIG. 2B are also in fluid communication within fluidic die 214 (e.g., within microchannels). As such, printing fluid may enter an ejection chamber via a first fluid feed hole (e.g., fluid feed hole 218*a*), traverse an ejection chamber, and a portion of the printing fluid that is not ejected may subsequently flow out of the firing chamber and the fluidic die via a second fluid feed hole (e.g., fluid feed hole 218*b*). This fluidic path is illustrated by arrow B. In one implementation, one or more circulation components may be arranged within fluidic die 214 in order to cause printing fluid to enter fluid feed hole 218*a* from fluid channel 212. Additionally (or alternatively), activation of ejection components (e.g., resistive elements) may exert a fluidic pressure within the fluid path illustrated by arrow B to cause fluid (e.g., all or part of the fluid indicated by the arrow A) to enter fluid feed hole 218*a*. Such circulation may be enabled by activation of a circulation component 227, by way of example. Circulation component 227 may comprise a resistive component, such as an embedded resistor, that may generate heat in response to current flow. Activation of circulation component 227 may facilitate fluid circulation, such as illustrated by arrow B. It is noted that while but a single circulation component 227 is illustrated, a number of circulation components may be arranged within other fluid feed holes to facilitate circulation. It may be in some cases that fluid may circulate through individual microchannels, as opposed to circulating through all ejection chambers concurrently. In other implementations, rather than using circulation components 227, due to external pressure (e.g., due to a pump external to fluid ejection device 205), printing fluid may be forced to enter fluid feed hole 218*a*.

As noted above, the combination of a plurality of fluid ports (e.g., fluid ports 102*a* and 102*b* in FIG. 1), a regulator (e.g., regulator 106 in FIG. 1), and a valve (e.g., valve 108 in FIG. 1), in combination with fluid ejection device 205 may enable circulation of printing fluid without a decrease in fluid flux.

In operation, therefore, printing fluid entering fluid ejection device 205 may be caused to be both ejected (in part) and to recirculate (in part). Thus, as shown by arrow A, printing fluid may enter a fluid slot (e.g., fluid slot 220*a*), may travel through a fluid channel 212, and may exit the fluid ejection device via another fluid slot (e.g., second fluid slot 220*b*). A portion of the printing fluid may be ejected from a fluidic die (e.g., fluidic die 214) via a nozzle (e.g., a nozzle 224), as illustrated by arrow C. And another portion of the printing fluid may be caused to circulate away from an ejection chamber and out of fluid ejection device 205 (e.g., as illustrated by the portion of arrow B traversing fluid feed hole 218*b* and the portion of arrow A traversing fluid channel 212 and fluid slot 220*b*). The circulation of printing fluid out of fluid ejection device 205 may be in response to application of a negative pressure, activation of a circulation element, activation of a plurality of ejection elements, or a combination thereof.

The next drawings focus on the support structure that enables flow of printing fluid in proximity to a back surface of a fluidic die.

Figure 3A:
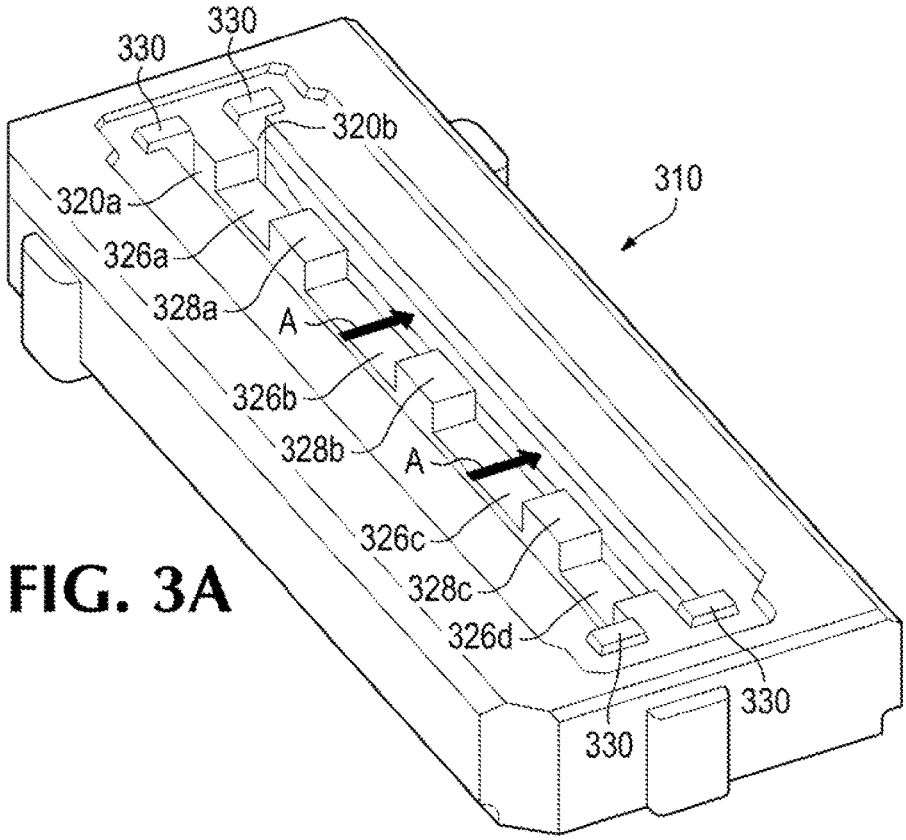
FIGS. 3A and 3B illustrate example support components for fluid ejection devices.
Figure 3B:
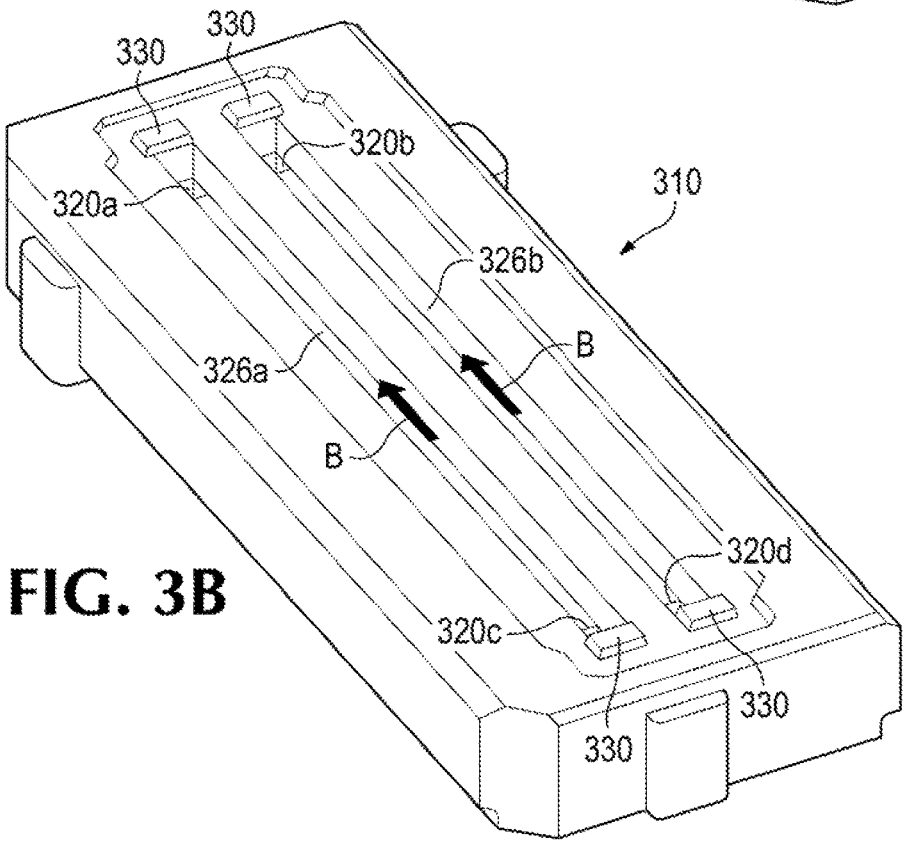

FIG. 3A illustrates an implementation in which fluid channels traverse a width of fluidic dies, while FIG. 3B illustrates an implementation in which fluid channels traverse a length of fluidic dies. FIGS. 3A and 3B may include components similar to those discussed previously. For example, a support component 310 may be similar to support components 210 illustrated in FIGS. 2A and 2B. Likewise fluid slots 320*a* and 320*b* may be similar to fluid slots 220*a* and 220*b* in FIGS. 2A and 2B. Etc.

FIGS. 3A and 3B also show example die supports 330 that may support and/or secure fluidic dies (not shown; see, e.g., fluidic die 214 in FIGS. 2A and 28) into support component 310 and/or provide protection against potentially damaging contact (e.g., by media, by a service blade, etc.).

Support component 310 may include gaps 326*a*-326*d* within the structure, such as to allow printing fluid to flow from fluid slot 320*a* to fluid slot 320*b*, as illustrated by arrows A. It should be understood that gaps 326*a*-326*d* may correspond to fluid channel 212 in FIG. 28, by way of example. Additionally, adhesive dots may be applied to support surfaces 328*a*-328*c* to secure the fluidic die to support component 310. In one example, there may be gaps in the adhesive layer corresponding to gaps 326*a*-326*d*. In some cases, a fluid channel (e.g., fluid channel 212 in FIG. 28) may be formed along a backside of a fluidic die without gaps 326*a*-326*d*. For instance, if a sufficiently thick adhesive layer is applied, gaps in the adhesive layer (e.g., similar to gaps 326*a*-326*d* in support component 310) between adhesive dots may be sufficient to form a fluid channel.

In contrast to FIG. 3A, in which gaps 326*a*-326*d* form fluid channels that extend across a width of the fluidic die, FIG. 3B illustrates an example in which fluid channels are arranged to run lengthwise across a back surface of the fluidic die.

FIG. 3B illustrates components that are similar to those discussed in FIG. 3A, including support component 310, fluid slots 320*a*-*d*, gaps 326*a* and 326*b*, and die supports 330. Nevertheless, gaps 326*a* and 326*d* are arranged with respect to fluidic dies such that printing fluid will enter gaps 326*a* and 326*b* (corresponding to, for instance, fluid channel 212 of FIGS. 2A and 2B) by fluid slots 320*c* and 320*d*. The printing fluid will traverse the length of the backside of the fluidic die, and will exit gaps 326*a* and 326*b* via fluid slots 320*a* and 320*b*. In some implementations, more than one pair of input and output ports (e.g., fluid slots 320*a* and 320*c*) may be formed within a gap (e.g., gap 326*a*). For instance, along one channel defined by a gap, there may be a first input port followed by a first output port, then a second input port followed by a second output port, etc. Such an implementation may be desirable to reduce a pressure drop along the length of the fluid channel defined by the gap in support component 310.

Figure 4:
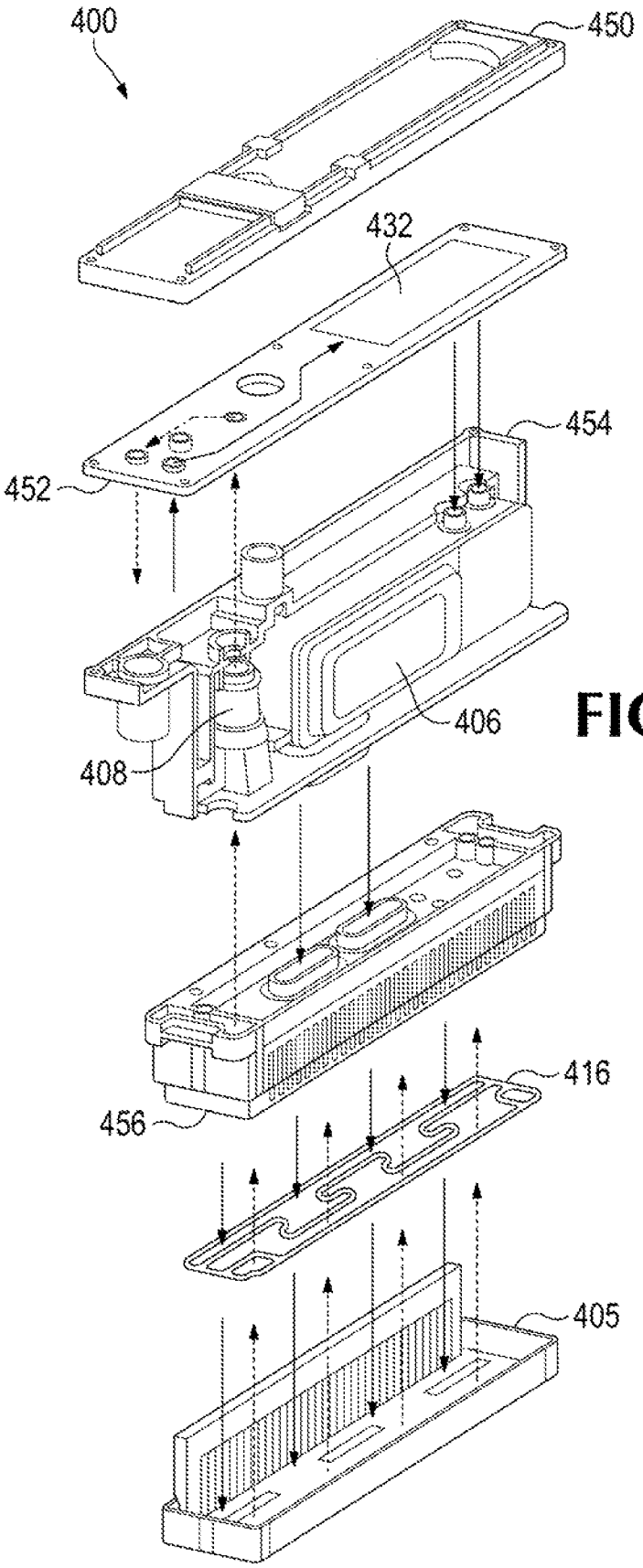
FIG. 4 is an exploded view of an example fluid ejection pen.

The next drawing, FIG. 4, illustrates an example fluid pen, including those structures discussed above, in relation to FIGS. 1-3B.

FIG. 4 illustrates an inkjet pen 400 and illustrates a flow of printing fluid in through a first fluid port and out of a second fluid port (e.g., fluid ports 102*a* and 102*b* in FIG. 1), where fluid flow out of pen 400 is illustrated by broken arrows and fluid flow into pen 400 is illustrated by solid arrows. A cap 450 refers to a structural component to enclose a top portion of pen 400, and may be in a suitable material including, but not limited to, thermoplastics. A filter 432 may be arranged in a fluidic plate 452 designed to facilitate directing fluid flow into and out of pen 400. For example, due, among other things, to recirculation of printing fluid, colorants may stick together and increase in size. Additionally, dust and debris may accumulate within circulating printing fluids. In such cases, filter 432, which may comprise a screen or a membrane, by way of non-limiting example, and may remove the undesirable particles (e.g., colorants, debris, etc.) from the printing fluid. Suitable materials for fluidic plate 452 may include thermoplastics, ceramics, glass, and metals, by way of non-limiting example. In one example, valve 408 and regulator 406 may be arranged within a body 454; valve 408 may enable flow of printing fluid out of pen 400; and regulator 406 may maintain flux for printing fluid entering fluid ejection device 405. A carrier 456 may act as a support structure, such as including support compound 210 discussed above in FIGS. 2A and 2B. Carrier 456 may include other components, including a fluid fan-out manifold, by way of non-limiting example. An adhesive layer 416 is illustrated as by connect carrier 456 to fluid ejection device 405.

It is noted that in one implementation, one pen 400 may house a fluid line and supporting components (such as a filter, a pressure regulator, a check valve, etc.) for a single color printing fluid (e.g., black). Additional pens may be used to support fluid lines for additional colors of printing fluid (e.g., cyan, magenta, yellow, white, etc.).

The next two drawings (and associated description) will discuss how the elements of FIGS. 2A, 2B, 3A, 3B, and 4 may operate together in order to enable fluid circulation within a pen while the pen is active (e.g., ejecting fluid) without reductions in printing fluid flux.

Figure 5A:
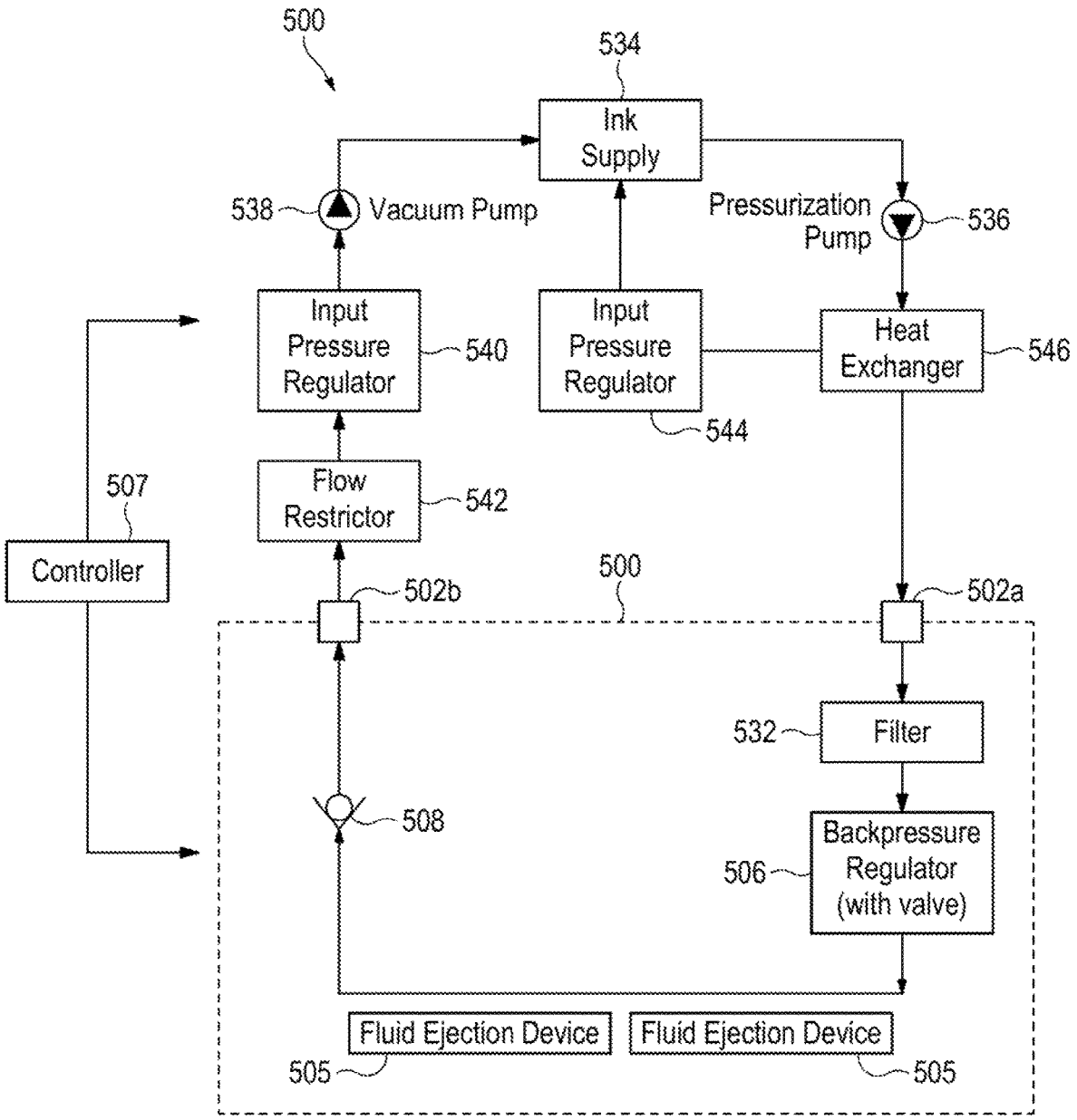
FIGS. 5A and 5B illustrate example printing fluid delivery systems.
Figure 5B:
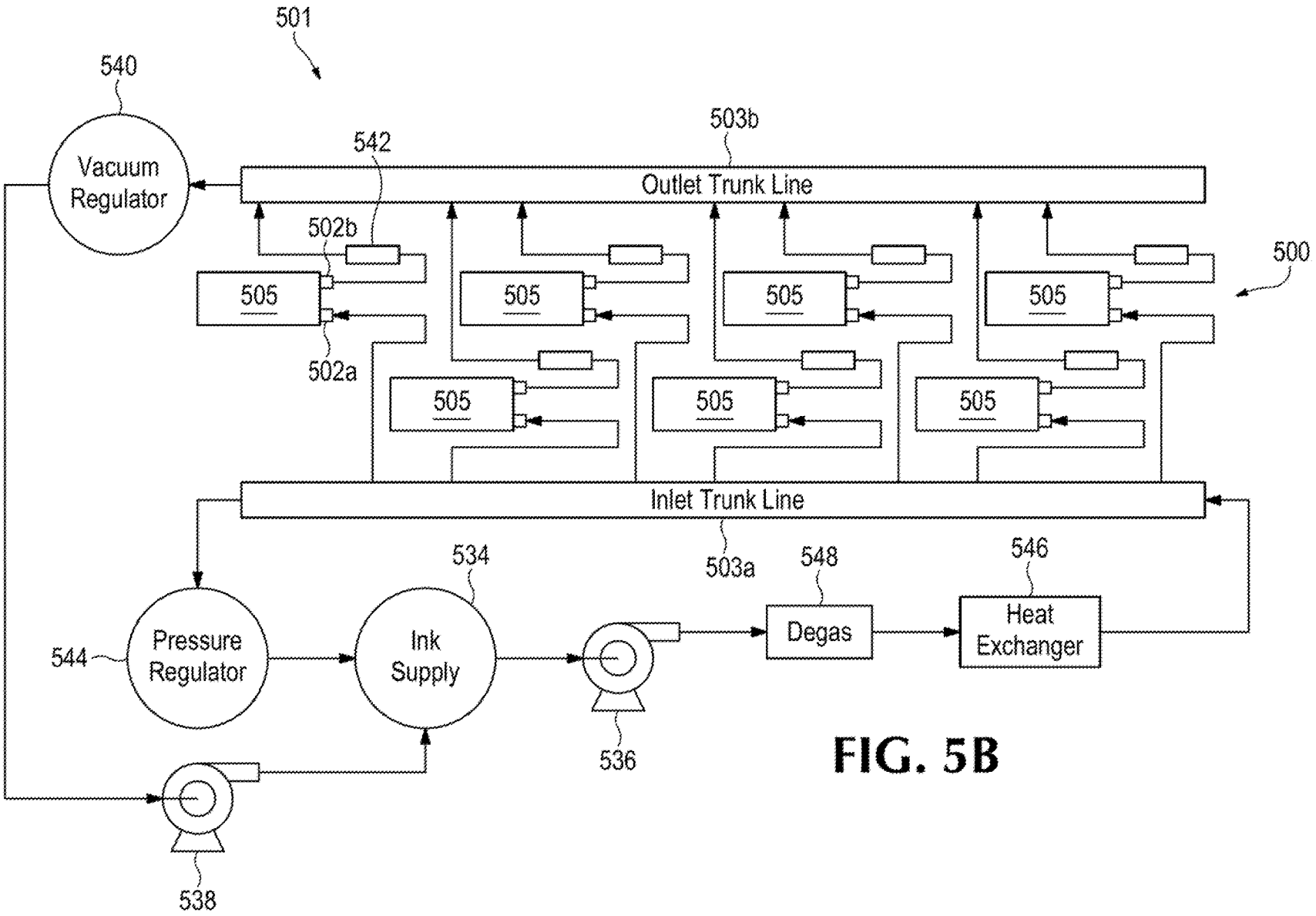

FIGS. 5A and 5B illustrate example printing fluid delivery systems 501 configured to enable circulation of printing fluid, such as across a backside of a fluidic die, without a reduction in flux, such as using an inkjet pen 500, similar in structure and/or operation to inkjet pen 100 in FIG. 1. Fluid ejection devices 505 may be similar in function and/or operation to fluid ejection device 105 in FIG. 1 and fluid ejection devices 205 in FIGS. 2A and 2B. Regulator 506 may be similar in structure and/or operation to regulator 106 in FIG. 1. And valve 508 may be similar in structure and/or operation to valve 108 in FIG. 1.

FIG. 5A also illustrates a filter 532, a printing fluid supply 534, a pump 536 (e.g., for pressurization at a first port), a pump 538 (e.g., for creating a vacuum at a second port), a pressure regulator 540, a flow restrictor 542, an input pressure regulator 544, and a thermal regulating component 546. A controller 507 may be in communication (e.g., via electrical signals exchanged) with components of printing fluid delivery system 501.

In one implementation, printing fluid supply 534 refers to a reservoir capable of receiving, storing, and releasing printing fluid. In one example, for instance, printing fluid may exit printing fluid supply 534 and may traverse fluid supply lines towards pen 500. Printing fluid that is not ejected by pen 500 may be recirculated back to printing fluid supply 534, as illustrated.

Pump 536 may be capable of applying a positive pressure on a fluid supply line, such as to cause printing fluid to flow towards pen 500. Pump 536 may take any suitable form including electromechanical and solid-state pumps, by way of non-limiting example.

In one implementation, a subloop through input pressure regulator 544 may be used to help maintain constant input pressure at fluid port 502*a*. For instance, as flux changes within pen 500 (e.g., due to pressure changes on a fluid line due to changes in drop ejection flux), input pressure regulator 540 may comprise a gate to dynamically open and/or close based on pressure on a fluid line after pump 536.

Thermal regulating component 546 refers to components capable of heating and/or chilling printing fluid prior to transmission thereof to pen 500. For example, there may be a desire, such as when a printing device is first turned on, to heat a fluidic die, such as to enable desirable operational parameters. Heating of printing fluid may also be desirable in order to reduce printing fluid viscosity. Similarly, at times there may be an interest in chilling a print head. For instance, at times a fluidic die may have portions that are exceeding a desired temperature. Additionally, in some cases there may be a desire to increase a viscosity of a printing fluid. Thus, in such cases, there may be a desire to transmit chilled printing fluid to pen 500. As should be appreciated, a thermal regulating component 546 may be desirable to yield a desired print quality (PQ).

After pressurization by pump 536 and/or traversing thermal regulating component 546, printing fluid may enter pen 500 via a first fluid port 502*a*, similar to as has been discussed above. Printing fluid may flow through filter 532 in order to remove any solids or debris exceeding a desired size, as discussed above. As should be apparent, then, in one case, a filter (e.g., filter 532) may be in fluid communication with a pressure regulator (e.g., regulator 506).

A portion of the printing fluid may be ejected via fluid ejection devices 505, as discussed above, and may be allowed to flow out of fluid port 502*b* as valve 508 is opened, such as in response to application of a negative pressure. In one example, negative pressure may be applied to valve 508 by pump 538. Pump 538 may comprise any suitable form of electromechanical or solid-state component (among other things) capable of applying a negative pressure on fluid port 502*b*. Flow restrictor 542 and regulator 540 may work in concert to ensure that a vacuum pressure does not exceed an acceptable threshold at port 502*b* analogously to the operation of regulator 506 and input pressure regulator 544. For example, if excessive pressure were to be applied by pump 538, a flux of printing fluid may exceed a threshold for providing acceptable pressure to fluid ejection devices 505. And flow restrictor 542 and regulator 540 may reduce such an occurrence.

It should be understood that controller 507 may be capable of enabling the operation of components, as discussed above, such as by transmitting signals to a desired component, such as via an electrical contact of a pen. Once received by the pen, the signals may be transmitted to enable operation, such as discussed above (e.g., causing ejection of printing fluid from a fluid ejection device).

FIG. 5B includes components similar in structure and/or operation to those discussed in FIG. 5A. For instance, FIG. 5B illustrates an inkjet pen 500, in fluid communication with a printing fluid supply 534, a pump 536, a thermal regulating component 546, a pressure regulator 544, a vacuum regulator 540, and a vacuum pump 538. FIG. 5B also illustrates a degas component 548, capable of removing gasses from printing fluid, such as by allowing air bubbles to separate from the fluid and be vented elsewhere. FIG. 5B also shows an inlet trunk line 503*a* through which printing fluid flows, after being pumped from pump 536. Printing fluid enters a number of fluid ejection devices 505 for ejection via fluidic lines and a first fluid port 502*a*. Printing fluid that is not ejected by fluid ejection devices 505 may be recirculated back towards printing fluid supply 534 via second fluid port 502*b*, may traverse a flow restrictor 542, and be directed to another fluid trunk line, this time an outlet trunk line 503*b*. As described, above, a valve in fluid ejection devices 505 may enable flow of printing fluid out of second fluid port 502, even while printing, without a reduction in flux.

Figure 6:
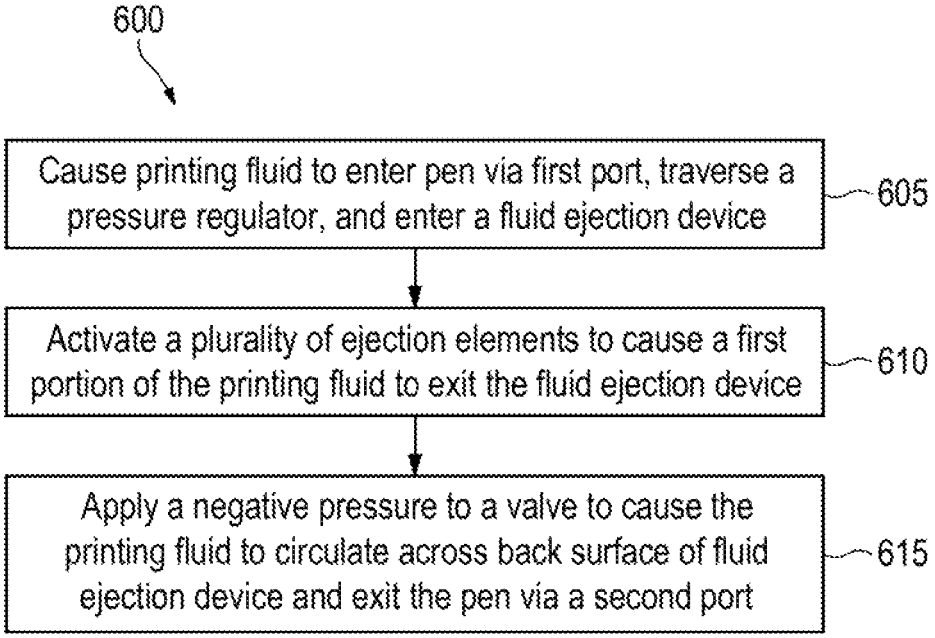
FIG. 6 is a flow diagram illustrating an example method for circulating printing fluid within a pen.

FIG. 6 illustrates a method 600 including blocks 605, 610, and 615. At block 605, a printing fluid is caused to enter a pen (e.g., pen 500 of FIG. 5A) via a first port (e.g., fluid port 502*a* of FIG. 5A). As noted above, fluid flow may be engendered responsive to operation of a pump, activation of ejection components, and activation of circulation components, by way of non-limiting example. Returning to example method 600, the printing fluid is to traverse a pressure regulator (e.g., regulator 506 of FIG. 5A) and enter a fluid ejection device (e.g., fluid ejection device 505).

At block 610, a plurality of ejection elements are activated in the fluid ejection device to cause a first portion of the printing fluid to exit the fluid ejection device (see, e.g., arrow C in FIG. 2B).

At block 615, a negative pressure is applied to a valve (e.g., valve 508 in FIG. 5A) in fluid communication with a second port (e.g., second fluid port 502*b* in FIG. 5A) of the pen to cause a second portion of the printing fluid to circulate across the back surface of the fluid ejection device (see, e.g., a second portion of arrow A in FIG. 2B) and to exit the pen while the plurality of ejection elements are being activated.

As should be apparent from the foregoing, the present disclosure proposes an approach for circulating fluid (e.g., behind a fluidic die) within a printing fluid ejection pen, while the pen is active (e.g., ejecting fluid) without drops in printing fluid flux.

In the preceding description, various aspects of claimed subject matter have been described. For purposes of explanation, specifics, such as amounts, systems and/or configurations, as examples, were set forth. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all modifications and/or changes as fall within claimed subject matter.

What is claimed is:

1. An inkjet pen comprising:

a plurality of fluid ports, a first fluid port to deliver printing fluid to a fluid ejection device and a second fluid port to direct printing fluid out of the pen;

a pressure regulator in fluid communication with the first fluid port of the plurality of fluid ports; and a valve in fluid communication with the second fluid port of the plurality of fluid ports;

in response to negative pressure, the valve to open to enable fluids within the pen to exit via the second fluid port.

2. The inkjet pen of claim 1 further comprising:

a support component connected to a fluidic die of the fluid ejection device; and a fluid channel arranged in the support component in proximity to a backside of the fluidic die.

3. The inkjet pen of claim 2, wherein the fluidic die comprises a plurality of fluid feed holes and the fluid channel is in fluid communication with the plurality of fluid feed holes.

4. The inkjet pen of claim 2, wherein the fluid channel is formed in gaps of an adhesive layer, gaps in a molded support, or a combination thereof.

5. The inkjet pen of claim 2, wherein the fluid channel is arranged with respect to the backside of the fluidic die so that fluids are to flow in contact with the backside of the fluidic die.

6. The inkjet pen of claim 2, wherein the fluid channel is arranged lengthwise with respect to a backside of the fluidic die.

7. The inkjet pen of claim 1, wherein the valve comprises a check valve.

8. The inkjet pen of claim 1 further comprising a filter in fluid communication with the pressure regulator.

9. The inkjet pen of claim 1, wherein the second fluid port is to direct the printing fluid out of the pen to a printing fluid supply.

10. A method of causing printing fluids to circulate across a back surface of a fluid ejection device within an inkjet pen, the method comprising:

causing printing fluid to enter the pen via a first port, the printing fluid to traverse a pressure regulator and enter a fluid ejection device;

activating a plurality of ejection elements in the fluid ejection device to cause a first portion of the printing fluid to exit the fluid ejection device; and applying a negative pressure to a valve in fluid communication with a second port of the pen to cause a second portion of the printing fluid to circulate across the back surface of a fluidic die of the fluid ejection device and to exit the pen while the plurality of ejection elements are being activated.

11. The method of claim 10, wherein the printing fluid enters the pen from a thermal regulating component.

12. The method of claim 10 further comprising causing a third portion of the printing fluid that is not ejected from the fluid ejection device to circulate out of an ejection chamber of the fluid ejection device and towards the second port, circulation of the third portion of the printing fluid being in response to application of the negative pressure, activation of a circulation element, activation of the plurality of ejection elements, or a combination thereof.

13. The method of claim 10, wherein the causing the printing fluid to enter the pen comprises causing the printing fluid to pass through a filter.

14. The method of claim 10, wherein the applying the negative pressure to the valve comprises applying a vacuum exceeding a threshold to open the valve.

15. A printing device comprising:

a pen comprising a plurality of fluid ejection devices, a first fluid port and a second fluid port, and an electrical contact, wherein the first and the second fluid ports are in fluid communication with the plurality of fluid ejection devices;

a pressure regulator in fluid communication with the first fluid port;

a check valve in fluid communication with the second fluid port; and a printing fluid supply reservoir also in fluid communication with the first fluid port; the electrical contact to receive signals from a controller to cause ejection of printing fluid from the plurality of fluid ejection devices;

wherein in response to application of a positive pressure at the first fluid port and a negative pressure at the second fluid port, printing fluid to flow along a portion of a backside of fluidic dies of the plurality of fluid ejection devices and to exit the pen via the second fluid port while printing fluid is ejected from the plurality of fluid ejection devices.

16. The printing device of claim 15 further comprising a flow restrictor in fluid communication with the second fluid port.

* * * * *